US006048224A

United States Patent [19]

Kay

[11] Patent Number: 6,048,224

[45] Date of Patent: Apr. 11, 2000

[54] SEALED MULTIPLE-CONTACT ELECTRICAL CONNECTOR

[75] Inventor: Andrew W. Kay, Fort Wayne, Ind.

[73] Assignee: Tekonsha Engineering Company, Tekonsha, Mich.

[21] Appl. No.: 08/948,340

[22] Filed: Oct. 9, 1997

[51] Int. Cl.[7] ..... H01R 13/56

[52] U.S. Cl. ..... 439/445; 439/519; 439/651

[58] Field of Search ..... 439/445, 271, 439/274–279, 932, 936, 519–522, 35, 34, 638, 650, 651, 655, 658; 174/76, 77 R, 138 F

[56] References Cited

U.S. PATENT DOCUMENTS

| | | | |
|---|---|---|---|
| 2,888,662 | 5/1959 | Hammell . | |
| 3,065,448 | 11/1962 | Hopkins et al. . | |
| 3,530,429 | 9/1970 | Scheller . | |
| 3,601,751 | 8/1971 | Pauza . | |
| 3,783,440 | 1/1974 | Karube et al. . | |
| 3,796,987 | 3/1974 | Kinkaid et al. . | |
| 3,827,007 | 7/1974 | Fairbairn et al. . | |
| 3,936,131 | 2/1976 | Durand . | |
| 3,998,518 | 12/1976 | Mathe . | |
| 4,017,141 | 4/1977 | Bury et al. . | |
| 4,346,959 | 8/1982 | Daugherty et al. . | |
| 4,371,227 | 2/1983 | Yosimura . | |
| 4,390,231 | 6/1983 | Plyler et al. . | |
| 4,472,017 | 9/1984 | Sian . | |
| 4,588,242 | 5/1986 | McDowell et al. . | |
| 4,693,767 | 9/1987 | Grzanna et al. . | |
| 5,137,478 | 8/1992 | Graf et al. | 439/874 |
| 5,207,603 | 5/1993 | Peloza | 439/884 |
| 5,226,837 | 7/1993 | Cinibulk et al. | 439/521 |
| 5,278,354 | 1/1994 | Lhomme . | |
| 5,298,300 | 3/1994 | Hosoi et al. . | |
| 5,382,171 | 1/1995 | Hofmann et al. | 439/142 |
| 5,470,622 | 11/1995 | Rinde et al. . | |
| 5,489,223 | 2/1996 | Faje et al. | 439/748 |
| 5,561,273 | 10/1996 | Yamanashi | 174/152 R |
| 5,626,479 | 5/1997 | Hughes | 439/35 |
| 5,800,188 | 9/1998 | Barber et al. | 439/142 |

OTHER PUBLICATIONS

TAP U.S.A 1997½ Catalog (Cover, Plus pp. 8 & 9).

*Primary Examiner*—Lincoln Donovan
*Attorney, Agent, or Firm*—Price, Heneveld, Cooper, DeWitt & Litton

[57] ABSTRACT

An environmentally protected, substantially sealed connector for attachment to a cable having a plurality of electrical conductors which are terminated at an end thereof with a contact, including a housing having a floor with a plurality of apertures therethrough arranged in a predetermined pattern and a backshell extending from the floor of the housing and encompassing the extended axes of the apertures, the backshell having at least one bead portion protruding from an outer surface of the outer backshell and extending at least partially around the backshell. A plurality of electrical contacts are disposed within the housing, each of the electrical contacts having a portion extending through one of the apertures and adapted to mate with one of the contact-terminated electrical conductors. Each of the electrical contacts has a locking member for retaining the associated contact in a fixed relationship to the floor. A diametrically shrinkable sheath extends from and is shrunk annularly about an exterior of the backshell, with a portion of the sheath engaging the bead. The sheath is also adapted to encompass an exterior of the cable of electrical conductors. An adhesive having a flow state is disposed within the sheath to coat at least portions of the electrical contacts of the cable of conductors when the sheath is shrunk about the cable and onto the backshell, to thereby insulate the coated portions of the contacts and sealingly protect them from the environment.

30 Claims, 3 Drawing Sheets

SEALED MULTIPLE-CONTACT ELECTRICAL CONNECTOR

BACKGROUND OF THE INVENTION

The present invention relates to electrical connectors, and more particularly to vehicle mounted, environmentally protected connectors which are substantially sealed from the elements.

Motor vehicles are typically outfitted with an electric connector or power outlet to facilitate the towing of general purpose trailers, other motor vehicles, recreational vehicles, trailorable homes, or the like. One of the requirements of towing the trailers or vehicles is that, depending upon the configuration of the trailer or vehicle being towed, electrical signals to energize brake lights, running lights, turn signal lights, and power for various accessory devices must be transmitted from the towing vehicle to the towed trailer or vehicle. To accomplish this, electrical conductors which are typically housed in a cable are routed to the rear of the vehicle and terminate at a connector mounted at or below the rear bumper of the towing vehicle. The connector has an internal contact configuration which is typically a standard throughout the industry to facilitate the connecting of an oppositely configured connector which is part of the towed vehicle or trailer.

The receptacle, when mounted at or below rear bumper level of the towing vehicle is subject to an environmental exposure which includes water, dust, snow, road salts, and the like. Such environmental exposure tends to corrode, short-circuit, and otherwise degrade the conductivity of electrical connections and thus diminish the operational efficiency of the connector. Prolonged environmental exposure can also result in the failure of the electrical connection, thus interrupting the electrical power and signals being transmitted to towed trailer or vehicle. The disruption of signals and power to functions such as brake lights, signal lights, and electric brakes poses a serious safety concern to the operators of the vehicles and has posed a problem for the manufacturers and users of such connectors.

The industry and using public have a requirement for a cable-connector combination which will reliably deliver electrical signals and electric power to a towed vehicle or trailer without the typical environmental conditions of road travel interfering with such electrical signals.

SUMMARY OF THE INVENTION

One aspect of the present invention is an environmentally protected connector of a sealed or substantially sealed character for attachment to a cable having a plurality of electrical conductors where each conductor is terminated at an end thereof with a contact. The connector includes a housing having a floor with a plurality of apertures therethrough arranged in a predetermined pattern. A backshell extends from the floor of the housing and encompasses the extended axes of the apertures, the backshell preferably having at least one bead portion protruding from an outer surface of the backshell and extending at least partially around the backshell. A plurality of electrical contacts are disposed within the housing, each of the electrical contacts having a portion extending through one of the apertures and adapted to mate with one of the contact-terminated electrical conductors. Each of the electrical contacts has a locking member for retaining the electrical contacts in a fixed relationship to the floor. A heat or otherwise activatable sheath extends from and is shrunk annularly about an extended portion of the backshell, a portion of the sheath engaging the bead. The sheath is also adapted to encompass the exterior of the cable of electrical conductors. A meltable or other adhesive having a flowable state is disposed within the sheath to coat all or portions of the conductor and electrical contacts of the cable when the sheath is activated to shrink it, to thereby insulate and seal the coated portions of the contacts from the environment while snugly wrapping the cable and sealing it to the backshell as well.

Another aspect of the invention is a connector shell for attachment to a cable having a plurality of electrical conductors. The connector shell includes a housing having a floor which has a plurality of apertures therethrough arranged in a predetermined pattern where the apertures are adapted to receive electrical contacts therethrough. An outer backshell extends from the floor of the housing and encompasses the extended axes of all of the apertures and has at least one bead portion protruding from an outer surface. The bead extends at least partially around the outer surface. An inner backshell extends from the floor of the housing and is disposed within the outer backshell. The inner backshell encompasses the extended axis of at least one of the apertures, but less than all of the extended axes of the apertures, to isolate at least one aperture from the others.

Yet another aspect of the invention is an environmentally protected connector for attachment to a cable having a plurality of electrical conductors where each conductor is terminated at an end thereof with a contact. The connector includes a housing having a floor and walls with an upper edge where the walls define a central cavity. The upper edge defines an opening to the cavity, and a flange extends laterally from the walls proximate to the upper edge. The floor has a plurality of apertures therethrough in a predetermined pattern. A cover encloses the cavity opening and is pivotally mounted to the flange. An edge of the cover defines a circular recess about a periphery of the cover. A biasing member cooperates with the flange and the cover to bias the cover toward a closed position. A resilient member retained within the recess is biased against the upper edge when the cover is in the biased-closed position. A backshell extends from the floor of the housing and encompasses the extended axes of the apertures. The backshell has at least one bead portion protruding from an outer surface and extends at least partially therearound. A plurality of electrical contacts are disposed within the housing, each of the electrical contacts having a portion extending through one of the apertures and mated to one of the electrical conductors. The portion extending through the aperture has a locking tab for retaining its respective contact in a fixed relationship to its corresponding aperture. A sealing member extends at least from the bead of the outer backshell to an exterior of the cable encompassing the electrical conductors for insulating the contacts and the conductors from the environment.

Still another aspect of the invention is an environmentally protected connector for attachment to a cable having a plurality of electrical conductors where each conductor is terminated at an end thereof with a contact. The connector includes a housing having a floor and walls with an upper edge where the walls define a central cavity. The upper edge defines an opening to the cavity, and a flange extends laterally from the walls proximate to the upper edge. The floor has a plurality of apertures therethrough in a predetermined pattern. A cover encloses the cavity opening and is pivotally mounted to the flange. An edge of the cover defines a circular recess about a periphery of the cover. A biasing member cooperates with the flange and the cover to bias the cover toward a closed position. A resilient member retained within the recess is biased against the upper edge when the cover is in the biased closed position. An outer backshell extends from the floor of the housing and encompasses the extended axes of the apertures. The outer backshell also has at least one bead portion protruding from an outer surface and extends at least partially around the outer backshell. An inner backshell extends from the floor and is concentrically disposed within the outer backshell. The inner backshell encompasses the extended axis of at least one of the apertures, but less than all of the apertures to isolate the one of the apertures from others of the apertures. A plurality of electrical contacts are disposed within the housing. Each of the electrical contacts has a portion extending through one of the apertures and further includes a locking tab for retaining the contact in a fixed relationship to its corresponding aperture. The plurality of electrical conductors are terminated with spade-type contacts which are mateably connected to the contact portions. A shrinkable sheath is shrunk onto the outer backshell and extends at least from the bead of the outer backshell to the exterior of the cable encompassing the electrical conductors. A meltable or other adhesive having a flowable state is disposed within the sheath such that when the sheath is activated to shrink it, the adhesive coats at least portions of the backshell interior, the contacts, and the electrical conductors to insulate the coated portions and protect them from the environment.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
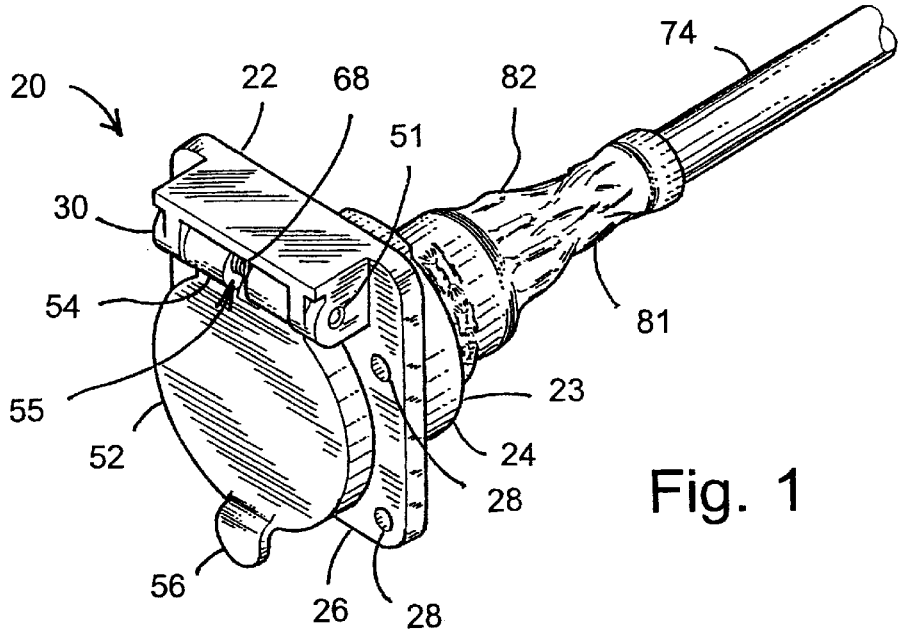
FIG. 1 is a perspective view of an environmentally sealed connector embodying the present invention, wherein a shrinkable sheath extends from the backshell of the connector to the conductor cable.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. In addition, the term "sealed" as used herein is used in a relative rather than absolute sense, and should be so understood.

Turning to the drawings, FIGS. 1–6 show an environmentally protected or sealed connector 20, which is one of the preferred embodiments of the present invention, and illustrates its various components.

Figure 3:
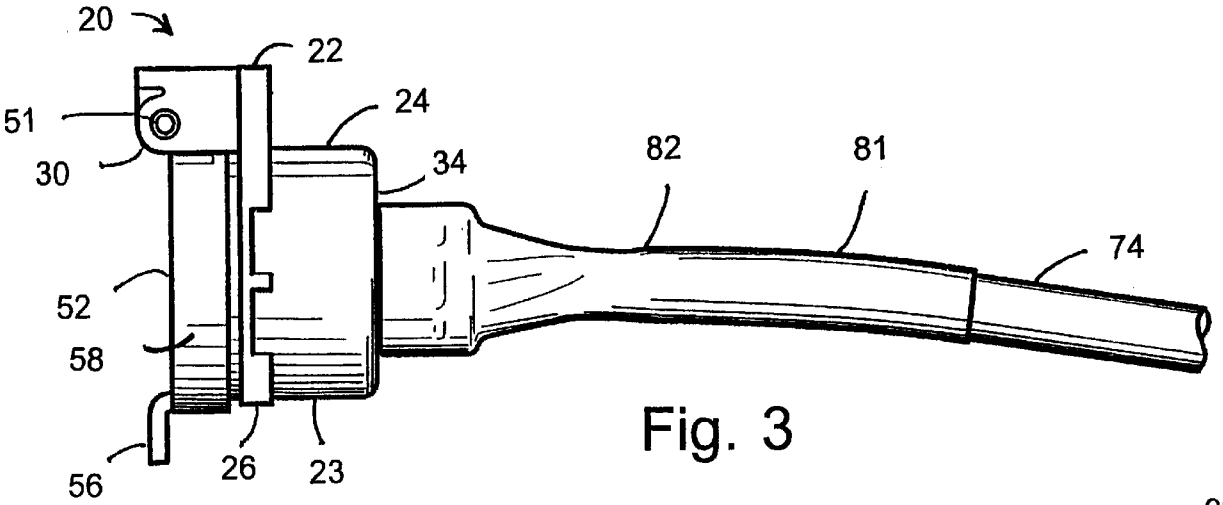
FIG. 3 is a side elevational view of the connector shown in FIG. 1, terminated to the electric cable.
Figure 5:
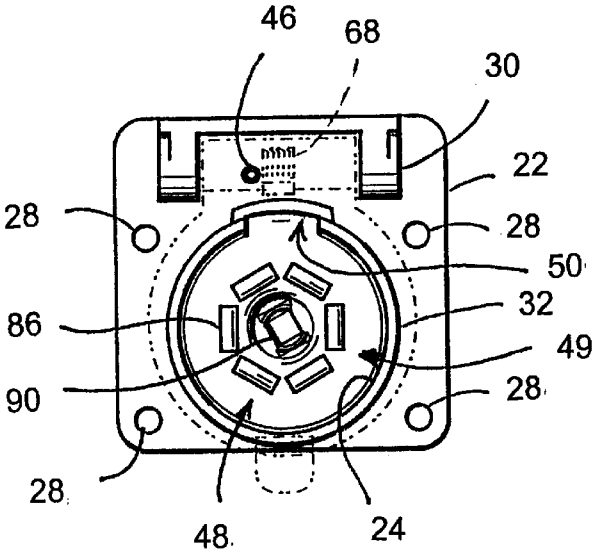
FIG. 5 is a front view of the connector shown in FIG. 1, with the cover removed and showing the contacts arranged inside the connector cavity.

The general configuration of the connector, most easily seen in FIGS. 1 and 3, includes a connector shell 22 which is generally comprised of a housing 23 having a rectilinear flange 26 and cover 52 disposed at one end thereof. In the preferred embodiment, housing 23 and cover 52 are formed from a moldable resin by known molding techniques. Flange 26 has a plurality of holes 28 proximate a periphery of flange 26 and extending therethrough for mounting connector 20 to a vehicle structure (not shown). Flange 26 has a fixed hinge 30 proximate to one edge thereof and in which rotatable hinge portion 54 of cover 52 is pivotally received and affixed thereto using hinge pin 51. Rotatable hinge portion 54 has a slot 55 therethrough wherein a biasing member 68 is disposed. In the preferred embodiment, biasing member 68 is a coiled torsion spring which is retained in place by hinge pin 51. Torsion spring 68 has a first free end (not shown) which is disposed in retaining hole 46 (FIG. 5) in flange 26. A second free end (not shown) of spring 68 bears against cover 52 in such a manner as to bias cover 52 toward a closed position to cover cavity opening 49 (FIG. 5). Cover 52 has a thumb tab 56 disposed substantially opposite from rotatable hinge portion 54 to aid a user to overcome the biasing force of spring member 68 to rotate cover 52 to an open position wherein cavity opening 59 is exposed.

Figure 6:
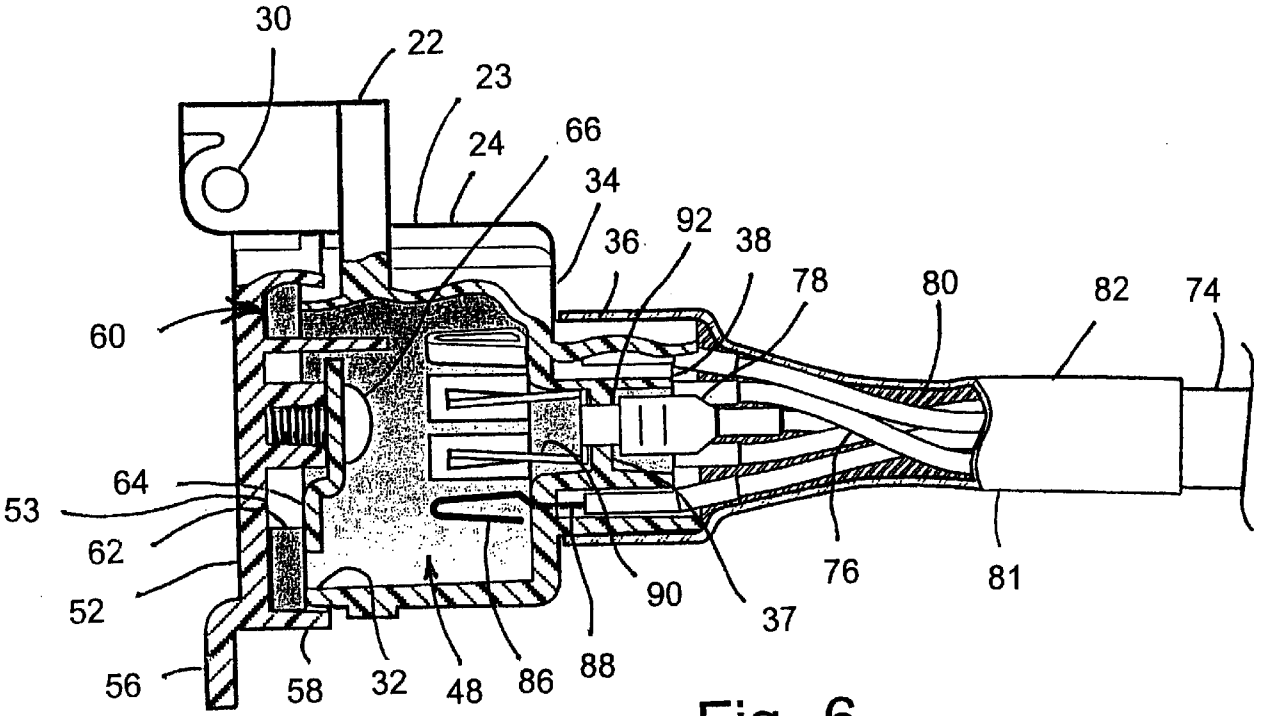
FIG. 6 is an enlarged, fragmentary, cross-sectional view of the connector showing the contacts extending through the housing floor and connected to the conductors of the electrical cable with the shrinkable sheath extending thereover.

Housing 23 further includes walls 24 which extend from a floor 34 to form cavity 48 (FIGS. 5 and 6). In the preferred embodiment, walls 24 comprise a cannularly configured wall 24. A sleeve-like outer sealing member 81 extends from the rear side of floor 34 to and over the outer covering of cable 74, to environmentally shield the interface of connector shell 22 and wire cable 74.

Referring to FIGS. 3 and 6, cover 52 in the preferred embodiment includes a lip 58 extending rearwardly and around the periphery of cover 52. Lip 58 in combination with bottom surface 53 of cover 52 defines a recessed portion 60 of cover 52. A resilient annular member 62 is disposed within recessed portion 60 and is retained therein by retainer 64 which, in turn, is fastened to cover 52 by screw 66. In use, when cover 52 is moved into its closed position by biasing member 68, annular lip 58 extends around the outside of the end edge 32 of housing 23 and resilient member 62 bears directly against end edge 32. In this manner cavity 48 is both shielded and effectively sealed from the environment when connector 20 is not interconnected with a mating plug. In either the open or closed position of cover 52, an outwardly projecting top flange 21 and side flanges 21A provide a partial cover or shield for hinge 30 and the entrance to cavity 48.

FIGS. 4–8 disclose additional features of housing 23. While walls 24 of housing 23 are generally cannularly shaped in the preferred embodiment, a keying slot 50 (FIG. 5) is provided at an upper portion of cannular wall 24.

Keying slot 50 functions to properly align mating terminals of a mating connector (not shown) with contacts 86 and 90 of connector 20 when the mating connector is plugged into the latter in use. Floor 34 has a plurality of apertures 44 therethrough (FIGS. 4, 6, 7, and 9) which in the preferred embodiment are rectilinear in shape and have a substantially greater length than width. Apertures 44 are generally arranged in annular fashion about the central axis of cannular wall 24 and may comprise any desired number, a total of six apertures 44 being shown for purposes of illustration. An additional central aperture 42 extends through floor 34 and is disposed near the center of floor 34. Those skilled in the art will appreciate that this particular geometric arrangement of apertures serves to configure connector 20 in a manner which conforms to an industry standard for connectors utilized to distribute electrical power and signals from a towing vehicle to a towed vehicle or trailer, but other such aperture configurations for alternate connector applications are possible. A central portion 37 of floor 34 may be disposed out of the plane of floor 34 to accommodate electrical contacts of a different configuration than accommodated by apertures 44, as discussed in greater detail below.

Figure 2:
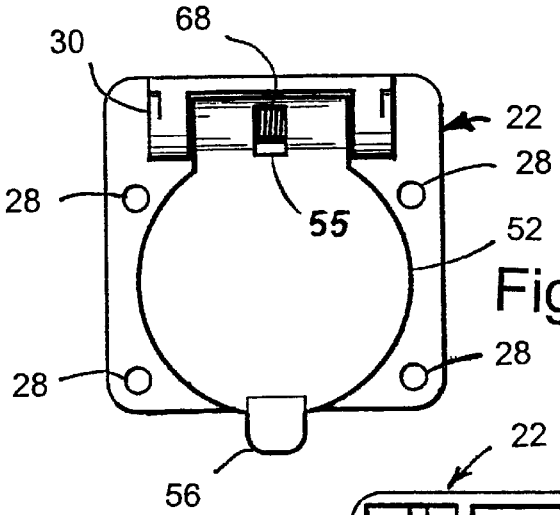
FIG. 2 is a front view of the connector shown in FIG. 1, showing the cover and mounting flange.
Figure 4:
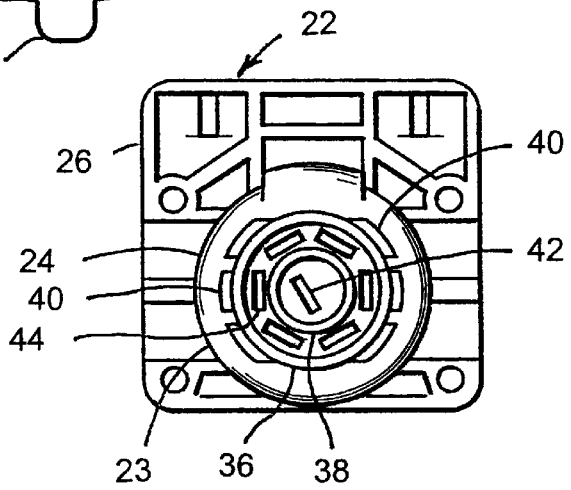
FIG. 4 is a rear view of the connector shell showing the apertures in the floor of the connector housing.
Figure 8:
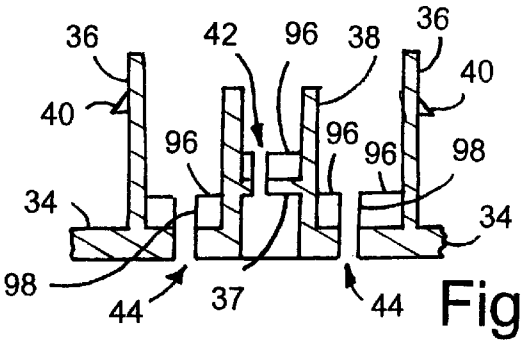
FIG. 8 is a fragmentary sectional view taken along the plane VIII—VIII of FIG. 7.

In the preferred embodiment, housing 23 has a cannularly shaped outer backshell 36 (FIGS. 4, 6, and 8) extending rearwardly from floor 34 substantially coaxial with cannular wall 24. Outer backshell 36 has a diameter sufficiently large enough to encompass the extended axes of apertures 42 and 44. Outer backshell 36 has a plurality of raised bead portions 40 protruding from an outer surface of outer backshell 36 and extending at least partially around outer backshell 36 (FIGS. 2, 4, and 8). The function of bead portions 40 will be discussed in greater detail below. An inner backshell 38 also extends from floor 34 and encompasses central portion 37 of floor 34 and central aperture 42. Inner backshell 38 functions to isolate aperture 42 and its associated electrical contact 90 received therein from apertures 44 and their associated contacts 86 received therein.

Figure 9:
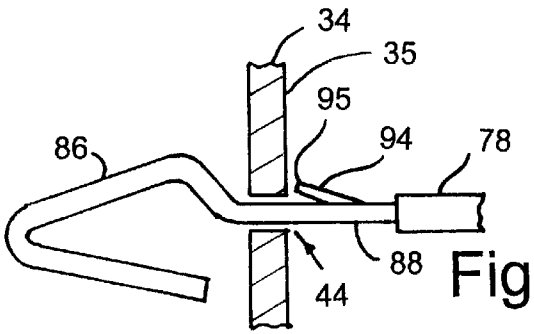
FIG. 9 is an enlarged view of a contact extending through the floor of the housing showing the locking tab holding the contact in a fixed relationship to the housing floor.

As shown in FIGS. 5, 6, and 9, electrical contact 90 and a plurality of electrical contacts 86 are inserted through apertures 42 and 44, respectively, to present an annular array disposed about a central electrical contact 90 for interconnection with a correspondingly arranged mating plug. Those skilled in the art will appreciate that the contact configuration as presented within cavity 48 of housing 23 is necessarily dictated by the contact configuration of the plug to be mated with connector 20, and vice versa. The portions of the electrical contacts within cavity 48 can be either male or female; however, a male portion 88 of contact 86, as most clearly seen in FIG. 9, extends through aperture 44 in floor 34; similarly, a portion 92 of contact 90 extends through central floor portion 37. Contact portion 88 is generally in the form of a rectilinear blade which is marginally smaller than aperture 44 to facilitate the extension of portion 88 through aperture 44. Portion 88 also incorporates a locking member 94 to retain electrical contact 86 in a fixed relationship with floor 34. In the preferred embodiment, locking member 94 comprises a locking tab which is a cantilevered tab attached at one end to portion 88 having a free end 95 which is displaced out of the plane of portion 88. As portion 88 is extended through aperture 44, the sides of aperture 44 flexibly displace cantilevered locking tab 94 to substantially coincide with the plane of portion 88 until free end 95 becomes disposed beyond outer floor surface 35. When portion 88 is fully extended through floor 34, free end 95 of locking tab 94 is disposed beyond the plane of outer surface 35 of floor 34, whereupon free end 95 of locking tab 94 springs back to its normal position out of the plane of portion 88. Free end 95 is thus disposed marginally outside of aperture 44 and bears against outer surface 35 of floor 34, thereby preventing the extraction of electrical contact 86 from floor 34 to maintain contact 86 in a fixed relationship to floor 34.

Referring now to FIG. 6, a cable 74 has a plurality of electrical wires or conductors 76 housed therein. Each of conductors 76 have a spade-type terminal 78 electrically connected thereto. Spade-type terminals 78 are well-known in the art. Each of conductors 76 terminated with a spade terminal 78 is connected to portion 88 of contact 86 or portion 92 of contact 90 in a female-male fashion thereby providing an electrically conductive path from conductors 76 to contacts 86 and 90.

As noted above and as further shown in FIG. 6, a sealing member 81 extends from an outer surface of outer backshell 36 to an external portion of wire cable 74. In the preferred embodiment, sealing member 81 is a heat-shrinkable polymeric sheath 82; it should be understood, however, that other types of shrinkable sheaths (e.g., R.F., Infra-red or other light spectra, chemically-activated, etc.) may also be used depending upon the relevant circumstances. Sheath 82 generally has a diameter somewhat larger than the outer surface of outer backshell 36 to initially fit over the latter, as well as over an external portion of wire cable 74. As heat or other activating media is applied to sheath 82, the material of which sheath 82 is comprised radially contracts to conform to the diameter and shape of outer backshell 36 and wire cable 74. Beads 40 of the preferred embodiment (shown in FIGS. 7 and 8) project outwardly from the outer surface of outer backshell 36. As sheath 82 is shrunk onto outer backshell 36, sheath 82 conforms around beads 40. With sheath 82 shrunk over and closely conforming to the external geometry of outer backshell 36, beads 40 function to prevent the inadvertent withdrawal of sheath 82 from the exterior of outer backshell 36. The close-fitting nature of sheath 82 about outer backshell 36 and wire cable 74 also functions to isolate contact portions 88 and spade terminals 78 from the environment.

In the preferred embodiment, where sheath 82 is heat-shrinkable, the sheath initially has a heat-meltable adhesive 80 disposed along its inner surface. Accordingly, as heat is applied to sheath 82 to activate its heat-shrinking properties, adhesive 80 is simultaneously melted to flow around and coat the adjacent parts, including backshell 30, at least a portion of conductors 76, spade terminals 78, and portions 88 of contacts 86 and 90 within sheath 82, to form a generally continuous, interspersed coupling and seal therebetween. The adhesive 80 initially disposed on the interior wall of sheath 82 can be supplemented with a heat-meltable or other such plug of adhesive which is inserted during assembly and melted upon the application of heat to sheath 82, to provide additional coating and mutual adhesion of the conductors and contacts. Also, adhesive 80 can be supplemented with an injectable adhesive which is injected into desired interior portions of sheath 82. Particularly if so supplemented, the adhesive may substantially fill all of the adjacent or proximate voids within the backshell and cable. It should be noted that other types of adhesive may also be used for the foregoing purpose, particularly where sheath 82 is shrinkable by means other than heat, so long as the adhesive has or can be put into a flowable state for the infusion stage, and will or can be made to set up after manufacture, during usage of the coupling.

Figure 7:
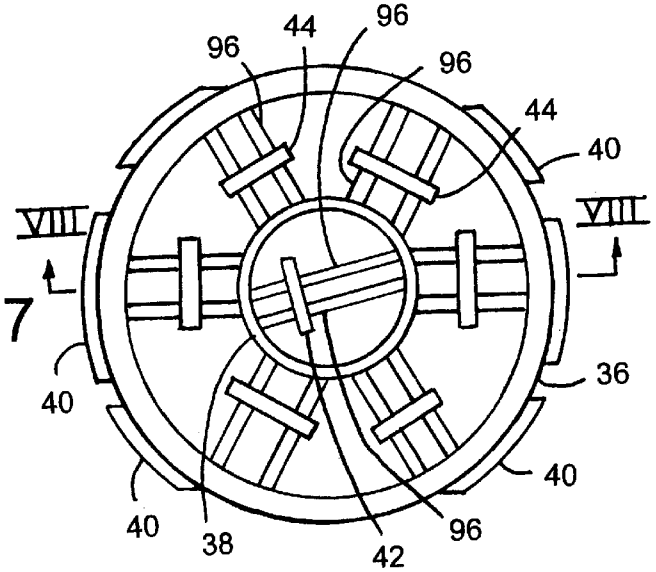
FIG. 7 is an enlarged view of the connector backshell area of FIG. 4, showing the ribs extending from the floor of the housing for stabilizing the contacts.

FIGS. 7 and 8 illustrate additional features of the backshell area of housing 22. Since the thickness of floor 34 is relatively small with respect to the length of electrical contacts 86 and portion 88 thereof extending through apertures 44, there is minimal support for maintaining contacts 86 substantially perpendicular to floor 34. To provide the required support to maintain contact 86 substantially perpendicular to floor 34, ribs 96 are provided which extend from floor 34 and are attached to outer and inner backshells 36 and 38. One or more ribs 96 are disposed at either side of apertures 44 and 42, with each rib 96 having a rib edge 98 which substantially coincides with a marginal edge of apertures 44 or 42. Rib edges 98 in combination with the marginal sides of apertures 42 and 44 function to maintain portions 88 and 92 of electrical contacts 86 and 90 substantially perpendicular to floor 34 and thus provide stable, firm contacts 86 and 90 to engage with those of a mating plug (not shown). In the preferred embodiment, two ribs 96 are disposed along each side of each aperture 44 and 42.

It is to be pointed out once again that while the foregoing disclosure addresses a particular preferred embodiment, and best mode, the particular apparatus described and the various detailed aspects thereof noted are regarded as pertaining to only the most preferred version of the invention and to merely illustrate the principles and concepts involved in the invention, other embodiments, and versions of the invention no doubt being feasible and potentially appropriate in other circumstances. It should therefore be understood that the foregoing description of a particular preferred embodiment is provided for purposes and illustration, and not as a measure of the invention, whose scope is to be defined solely by reference to the ensuing claims. Embodiments of the invention differing from those set forth above which nonetheless utilize the underlying concepts of the invention and incorporate its spirit should therefore be considered as within the scope of the claims appended below, unless such claims by their language specifically state otherwise.

The claimed invention is:

1. An environmentally protected connector member for substantially sealed attachment to a cable having a plurality of electrical conductors which are terminated at an end thereof with a contact, said connector member comprising one of a pair of releasably interconnectable coupling components and including:

a housing having a floor, said floor having a plurality of apertures therethrough arranged in a predetermined pattern;

a backshell extending from said floor of said housing and encompassing the extended axes of said apertures, said backshell having at least one bead portion protruding from an outer surface of said backshell and extending at least partially therearound;

a plurality of electrical contacts within said housing, each of said electrical contacts adapted to releasably engage a corresponding electrical contact of another of said coupling components releasably interconnected to said connector member and having a portion extending through one of said apertures which is adapted to slidably mate with the said contact terminating one of said electrical conductors;

a locking member for retaining said electrical contacts in a fixed relationship to said floor;

an outer sheath of diametrically shrinkable material extending from and shrunk annularly tightly about an exterior of said backshell, to fixedly secure the sheath and backshell together, a portion of said sheath extending over and engaging at least portions of said bead in fixed and interlocking relationship to augment the connection between said sheath and said backshell, said sheath adapted to encompass an exterior of said cable of electrical conductors; and an adhesive having a flowable state disposed within said sheath to coat at least portions of said backshell exterior, said cable, and said electrical contacts of said cable of conductors when said sheath is shrunk annularly about said backshell, to thereby join said backshell and cable together in a substantially sealed manner and also cover and protect said coated portions of said contacts from the environment.

2. The environmentally protected connector of claim 1 wherein said backshell comprises:

an outer backshell encompassing the extended axes of all of said apertures; and an inner backshell disposed within said outer backshell, said inner backshell encompassing the extended axis of at least one of said apertures but less than all of the extended axes of said apertures to separate and generally isolate said at least one of said apertures from others of said apertures.

3. The environmentally protected connector of claim 2 further comprising:

a plurality of ribs extending from and substantially perpendicular to said floor, each of said ribs having an edge substantially coincident with an edge of one of said apertures for maintaining the position of a contact extending through said one of said apertures substantially perpendicular to said floor.

4. The environmentally protected connector of claim 3 wherein substantially all of said apertures has at least a first and a second of said rib edges adjacent thereto, and further wherein said first rib edge is disposed adjacent one side of its associated aperture and said second rib edge is disposed adjacent a substantially opposite side of such aperture.

5. The environmentally protected connector of claim 4 wherein:

said first rib edge comprises a pair of laterally disposed rib edges; and said second rib edge comprises a pair of laterally disposed rib edges.

6. The environmentally protected connector of claim 2 wherein said inner and said outer backshells are cannularly shaped.

7. The environmentally protected connector of claim 6 wherein said inner and said outer backshells are substantially co-axial.

8. The environmentally protected connector of claim 7 wherein said less than all of the extended axes of said apertures are annularly disposed between said inner and said outer backshells.

9. The environmentally protected connector of claim 1 wherein said adhesive comprises a layer of heat-meltable adhesive disposed along an inner wall of said sheath.

10. The environmentally protected connector of claim 1 wherein said adhesive comprises, at least in part, a plug of generally solid adhesive having an activatable flow state and adapted to be insulated inside said sheath prior to shrinking of said sheath.

11. The environmentally protected connector of claim 1 wherein said adhesive within said sheath comprises at least in part an injectable adhesive.

12. The environmentally protected connector of claim 1 wherein said housing includes walls extending substantially perpendicular from said floor, said walls in combination with said floor defining a cavity adapted to receive a mating electrical plug, said walls having an upper edge defining the entrance to said cavity.

13. The environmentally protected connector of claim 12 further including a cover pivotally mounted to said housing and having a closed position wherein said cover has a portion which abuts said upper edge of said walls.

14. The environmentally protected connector of claim 13 wherein said cover includes a resilient member for abutting said upper edge of said walls.

15. The environmentally protected connector of claim 13 further including a spring for biasing said cover to said closed position.

16. The environmentally protected connector of claim 1 wherein said locking member is a tab.

17. The environmentally protected connector of claim 16 wherein said tab is attached in cantilevered fashion to said portion of said contact extending through one of said apertures and projects outwardly from said extending portion of said contact, and further wherein said tab is disposed therealong such that a free end of said tab abuts a surface of said floor to maintain said contact in a closely held relationship with respect to said floor.

18. The environmentally protected connector of claim 17 wherein said tab is substantially centered in said extending portion of said contact.

19. A connector shell for attachment to a cable having a plurality of electrical conductors, said connector shell comprising:

a housing having a floor, said floor having a plurality of apertures therethrough arranged in a predetermined pattern, said apertures adapted to receive electrical contacts therethrough;

an outer backshell extending from said floor of said housing and encompassing the extended axes of said apertures an inner backshell extending from said floor of said housing and disposed within said outer backshell, said inner backshell encompassing the extended axis of at least one of said aperture but less than all of the extended axes of said apertures to isolate said at least one of said apertures from others of said apertures; and said less than all of the extended axes of said apertures being disposed between said inner and said outer backshells.

20. The connector shell of claim 19 further comprising:

a plurality of ribs extending from and disposed substantially perpendicular to said floor, each of said ribs having an edge substantially coincident with an edge of one of said apertures for maintaining a contact extending through said one of said apertures in a position substantially perpendicular to said floor.

21. The connector shell of claim 20 wherein each of said apertures has at least a first and a second of said rib edges adjacent thereto and further wherein said first rib edge is disposed adjacent one side of said aperture and said second rib edge is disposed adjacent a substantially opposite side of said aperture.

22. The connector shell of claim 19 wherein said inner and said outer backshells are cannularly shaped.

23. The connector shell of claim 22 wherein said inner and said outer backshells are co-axial.

24. The connector shell of claim 23 wherein said less than all of the extended axes of said apertures are annularly disposed between said inner and said outer backshells.

25. The connector shell of claim 19 wherein said housing includes walls extending substantially perpendicular from said floor, said walls in combination with said floor defining a cavity adapted to receive a mating electrical plug, said walls having an upper edge defining the entrance to said cavity.

26. The connector shell of claim 25 further including a cover pivotally mounted to said housing and having a closed position wherein a surface of said cover abuts said upper edge of said walls.

27. The connector shell of claim 26 wherein said cover further includes a resilient member affixed to said surface of said cover for abutting said upper edge of said walls.

28. An environmentally protected connector for substantially sealed attachment to a cable having a plurality of electrical conductors, each such conductor terminated at an end thereof with an electrical contact, said connector comprising:

a housing having a floor and walls with an upper edge, said walls defining a central cavity, said upper edge defining an opening to said cavity, and said floor having a plurality of apertures therethrough arranged in a predetermined pattern;

a flange extending laterally from said walls proximate to and projecting over portions of said upper edge to hood such portions;

a cover for closing said cavity opening, said cover pivotally mounted adjacent to and at least partially underlying said flange to be hooded thereby at its axis of pivotal mounting;

a biasing member cooperating with said housing and said cover to bias said cover toward a closed position;

a seal carried by said cover to be biased against said upper edge when said cover is in said closed position;

a backshell extending from said floor of said housing and encompassing the extended axes of said apertures;

a plurality of releasably electrically engageable electrical terminals secured in place within said housing, each of said electrical terminals having a portion extending through one of said apertures and connected to one of the said electrical contacts of said conductors, said terminal portion having a locking member for retaining its respective one of said terminals in a fixed relationship to its corresponding one of said apertures; and a sealing member extending at least from said outer backshell to an exterior of the cable and encompassing the electrical conductors thereof, for shielding said contacts and the conductors from the environment.

29. An environmentally protected connector for attachment to a cable having a plurality of electrical conductors, each conductor terminated at an end thereof with a contact, said connector comprising:

a housing having a floor and walls with an upper edge, said walls defining a central cavity, said upper edge defining an opening to said cavity, and said floor having a plurality of apertures therethrough in a predetermined pattern;

a flange extending laterally from said walls proximate to said upper edge;

a cover for enclosing said cavity opening, said cover pivotally mounted to said housing adjacent said flange;

a biasing member cooperating with said housing and said cover to bias said cover toward a closed position;

an outer backshell extending from said floor of said housing and encompassing the extended axes of said apertures, said outer backshell having at least one bead portion protruding from an outer surface of said outer backshell and extending at least partially therearound;

an inner backshell extending from said floor and concentrically disposed within said outer backshell, said inner backshell encompassing the extended axis of at least one of said apertures, but less than all of the extended axes of said apertures to isolate said at least one of said apertures from others of said apertures;

a plurality of electrical contacts within said housing, each of said electrical contacts having a portion extending through one of said apertures and mated to one of the electrical conductors, said portion having a locking member for retaining its respective one of said contacts in a fixed relationship to its corresponding one of said apertures;

a sheath of heat-shrinkable material shrunk onto and secured fixedly to said outer backshell and extending from said at least one bead of said outer backshell to an exterior of a cable to surround said electrical conductors; and an adhesive disposed within said sheath, said adhesive having a flow state and arranged to coat at least portions of an interior of said backshells, at least portions of said contacts, and at least portions of said electrical conductors when said sheath is heat-shrunk onto said outer backshell and about said cable, to insulate said coated portions from the environment.

30. An environmentally protected connector as recited in claim 29, wherein said sheath covers at least portions of said at least one bead and is heat-shrunk onto such bead portions to additionally secure said sheath to and augment retention of said sheath upon said backshell.

* * * * *